United States Patent [19]

Antonious

[11] Patent Number: 4,948,140

[45] Date of Patent: Aug. 14, 1990

[54] GOLF CLUB HEAD WITH DUAL TRIANGULAR HOSEL

[76] Inventor: Anthony J. Antonious, 205 E. Joppa Rd., Towson, Md. 21204

[21] Appl. No.: 445,790

[22] Filed: Dec. 4, 1989

Related U.S. Application Data

[63] Continuation-in-part of Ser. No. 304,261, Jan. 31, 1989, abandoned.

[51] Int. Cl.[5] ..... A63B 53/02; A63B 53/04

[52] U.S. Cl. ..... 273/169; 273/167 G; 273/80.2; 273/164

[58] Field of Search ..... 273/167–175, 273/80.2–80.9, 77 R, 77 A, 164, 183 D, 186 A; D21/217–219

[56] References Cited

U.S. PATENT DOCUMENTS

| | | | |
|---|---|---|---|
| D. 248,783 | 8/1978 | Long | D21/217 |
| D. 259,732 | 6/1981 | Vella | D21/217 X |
| D. 299,043 | 12/1988 | Antonious | D21/217 |
| 3,037,770 | 6/1962 | Palmer | 273/167 G |
| 3,595,577 | 7/1971 | Hodge | 273/80 C |
| 4,265,451 | 5/1981 | Bernhardt | 273/167 G |
| 4,747,599 | 5/1988 | Antonious | 273/167 G |

OTHER PUBLICATIONS

Fishman, L., "Need a New Putter?", Golf Digest, Dec. 1988, p. 97, FIG. 12.

*Primary Examiner*—Edward M. Coven
*Assistant Examiner*—Sebastiano Passaniti
*Attorney, Agent, or Firm*—Nicholas J. Aquilino

[57] ABSTRACT

A putter type golf club head formed of a club head body having a ball striking face and an upper surface, a shaft connecting socket and a dual triangular hosel connected between the socket and the upper surface of the club head body formed of a first triangular member positioned in a plane parallel to the ball striking face and a second triangular member positioned in a plane perpendicular to the ball striking face.

12 Claims, 3 Drawing Sheets

GOLF CLUB HEAD WITH DUAL TRIANGULAR HOSEL

RELATED APPLICATIONS

The present invention is a continuation in part of Ser. No. 07/304,261, filed Jan. 31, 1989, titled GOLF CLUB HEAD WITH DUAL TRIANGULAR HOSE, now abandoned.

BACKGROUND OF THE INVENTION

The present invention relates to golf club heads, and in particular to a putter-type golf club head having an improved hosel structure connecting the shaft-engaging socket and club head body.

Various types of structures have been developed to provide a solid connection between a golf club shaft and a putter head to provide maximum transfer of energy, while also maximizing the feel transferred to the user's hand when a golf ball is struck with the club head. In applicant's own U.S. Pat. No. 4,747,599, a golf club putter is disclosed using a triangular shaped hosel positioned perpendicular to the ball striking face. In U.S. Design Pat. Nos. 294,514, 293,809 and 293,926 among others, applicant uses a triangular shaped hosel parallel to the ball striking face.

The present invention provides a putter-type golf club head having a novel hosel structure which provides more stability and decreases the tendency of the golf club head to torque or rotate when a ball is struck off the center of percussion or the center of gravity on the club head while maintaining maximum energy transfer between the shaft and the ball striking face, and maintaining maximum feel to the user when a golf ball is struck.

The club head is provided with a dual triangular shaped hosel between the shaft engaging socket and the upper surface of the club head body formed of a first triangular member positioned in a plane parallel to the ball striking face, and a second triangular member positioned in a plane perpendicular to the ball striking face. The base of the first triangular shaped member extends from a point adjacent the heel on the top surface or along the top ridge of the club head body to a position between the heel and toe of the club head, and forms a ninety degree junction at the point where the hosel terminates on the top ridge. A second triangular member is positioned in a plane perpendicular to the ball striking face, and extends rearwardly from a point on the top surface or the top ridge to a second point adjacent the rear edge of the club head. The first and second hosel members are integrally formed to have a common vertical side extending upwardly from the top ridge to the shaft engaging socket.

Among the objects of the present invention are the provision of an improved hosel structure for a putter-type golf club head, which provides additional support, and helps brace the putter head to resist opposing torquing or twisting forces created by off-center impacts on a golf ball; the provision of an improved golf club head having a dual triangular hosel having a first hosel member parallel to the ball striking face, and a second hosel member perpendicular to the ball striking face to improve the energy transfer and feel between the user's hands and the club head.

DESCRIPTION OF PREFERRED EMBODIMENT

Figure 1:
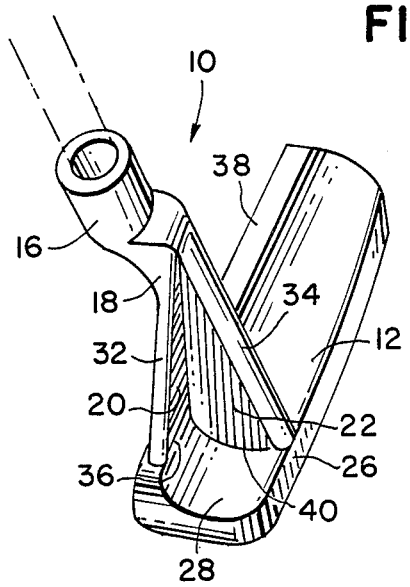
FIG. 1 is a rear perspective view of the putter-type golf club head of the present invention.
Figure 2:
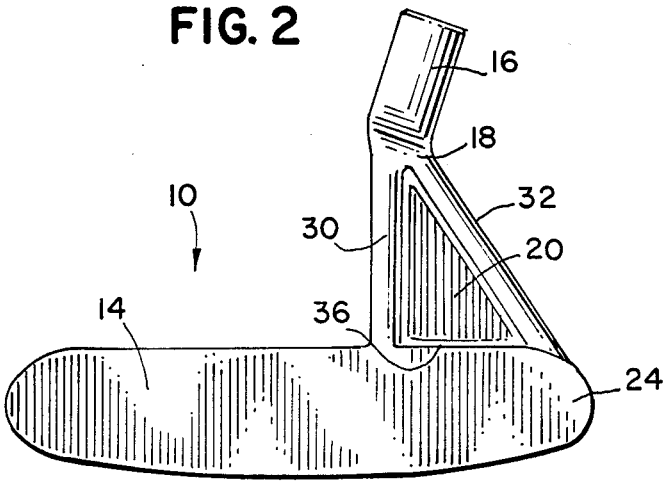
FIG. 2 is a front elevation of the view thereof.
Figure 3:
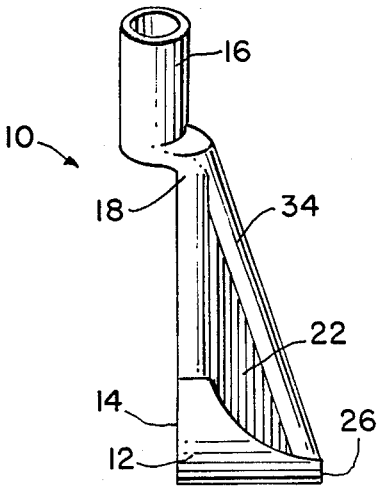
FIG. 3 is an end elevation of the view thereof.

FIGS. 1 to 3 show a golf club head 10 of the present invention including a body 12, ball striking face 14, shaft engaging socket 16, and a dual triangular hosel 18 formed of a first triangular member 20 positioned in a plane parallel to the ball striking face 14, and a second triangular member 22 positioned in a plane perpendicular to the ball striking face 14.

The triangular members 20 and 22 are integrally formed to have a common vertical side 30 extending in a vertical direction between the club head body 12 and the socket 16. The triangular member 20 includes a hypotenuse portion 32 between the socket 16 and the heel 24 of the club head 10. The triangular member 22 also includes a hypotenuse portion 34 extending from the socket 16 to the rear edge 26 of the club head 10. The base 36 of the triangular member 20 lies on the top ridge 38 of the club head body 12 adjacent to the ball striking face 14. The base 40 of the triangular member 22 lies on the upper surface of a rearwardly extending flange 28 formed on the club head body 12.

Figure 4:
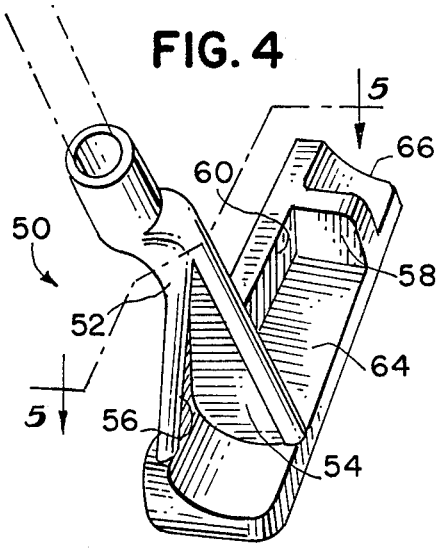
FIG. 4 is a rear perspective view of a second embodiment of a putter-type golf club head of the present invention.
Figure 5:
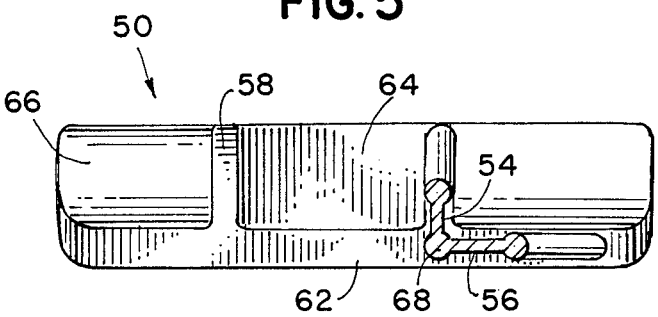
FIG. 5 is a top plan view of FIG. 4 shown partially in section along the line 5—5 of FIG. 4.
Figure 6:
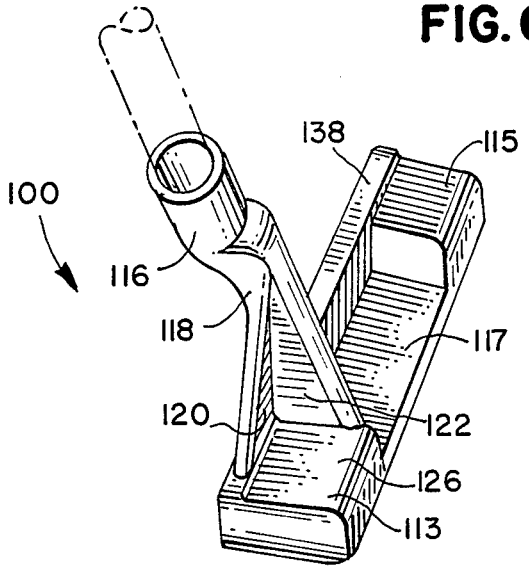
FIG. 6 is perspective view of a third embodiment of a putter-type golf club head of the present invention.
Figure 7:
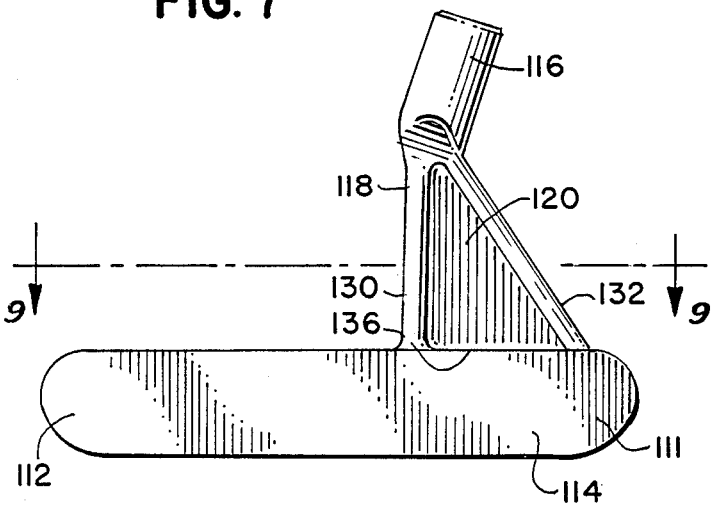
FIG. 7 is a front elevational view of FIG. 6.
Figure 8:
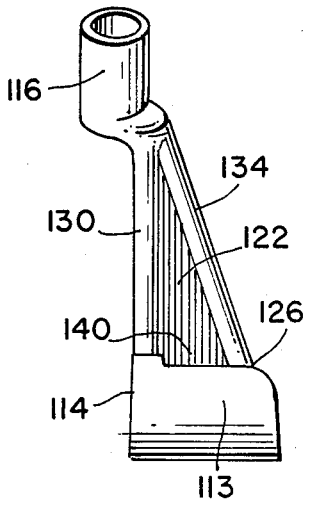
FIG. 8 is an end elevational view of FIG. 6.
Figure 9:
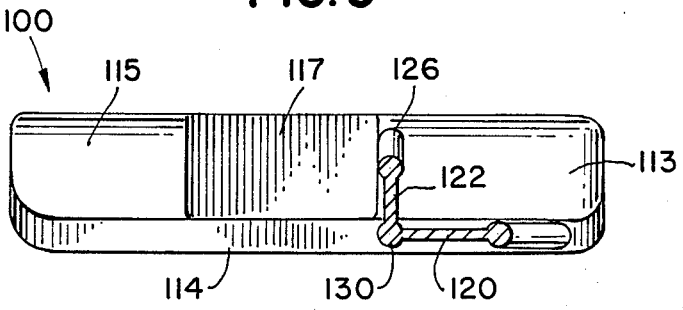
FIG. 9 is a top view of FIG. 7 shown in section along the line 9—9 of FIG. 7.

FIGS. 4 and 5 show an alternate embodiment of a club head 50 of the present invention including a dual triangular hosel 52 having triangular members 54 and 56 structured and positioned in the same manner as the embodiment described with respect to FIGS. 1, 2 and 3 hereinabove. This embodiment includes a complementary weight in the form of an opposing upstanding boss 58 adjacent the toe 66 of the club head 50 behind the rear wall 60 of the ball striking face 62 and extending upwardly from the flange 64. The boss 58 is located on the side of the club head opposite the dual triangular hosel 52. The boss 58 lies in a plane perpendicular to the ball striking face 62, and parallel to the triangular member 54. The boss 58 balances the weight of the dual triangular hosel 52 to provide a more equal weight distribution of the club club head 50.

Referring to FIG. 5, it can be seen that triangular members 54 and 56 include a common upright side 68, and are positioned 90 degrees to each other.

FIGS. 6 through 9 illustrate a third embodiment of a putter type golf club head 100 including a heel 111, toe 112, a heel mass 113, a ball striking face 114 and a toe mass 115. The golf club head 100 includes a rear cavity 117 formed between the heel mass 113 and toe mass 115 to provide a heel-toe weight distribution to the club head 100. A shaft engaging socket is located on the upper portion of a dual triangular hosel 118 formed of a first triangular member 120 positioned in a plane parallel to the ball striking face 114 and a second triangular member 122 positioned in a plane perpendicular to the ball striking face 114.

The triangular members 120 and 122 are integrally formed to have a common vertical side 130 extending in a vertical direction between the top ridge 138 on the club head and the shaft engaging socket 116. The triangular member 120 includes a hypotenuse portion 132 between the heel 111 and the socket 116 of the club head 100. The triangular member 122 also includes a hypotenuse portion 134 extending from the socket 116 to the top rear edge 126 of the heel mass 113 of the club head 100. The base 136 of the triangular member 120 lies on the top ridge 138 adjacent the ball striking face 114. The base 140 of the triangular member 122 lies on the top surface of the heel mass 113.

This structure provides all the advantages of a heel-toe weighted configuration, and also includes the advantage of the dual hosel structure to maximize the transfer of energy between the shaft and the club head in a direction both parallel and perpendicular to the ball striking face to impart maximum energy to a ball being struck while minimizing twisting torque and vibration when a golf ball is struck.

Figure 10:
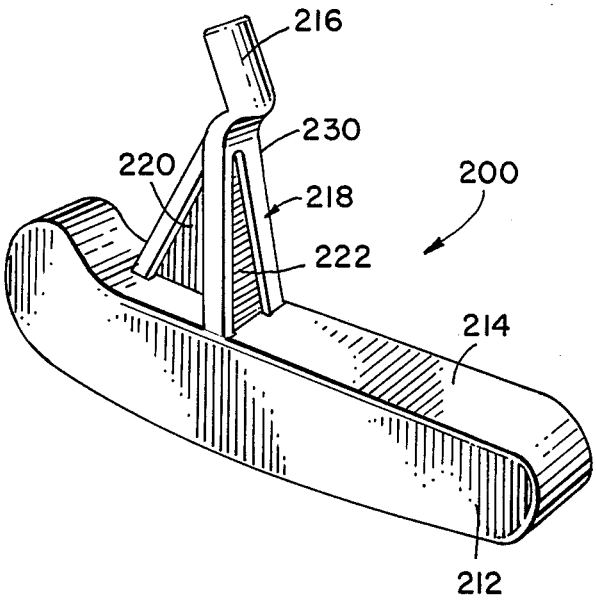
FIG. 10 is a perspective view of a fourth embodiment of the present invention.

FIG. 10 shows a fourth embodiment of a wide blade putter type golf club head 200 including a club head body 212 having an upper surface 214, a shaft engaging socket 216 and a dual triangular hosel 218 positioned on the upper surface 214 and connecting the shaft engaging socket 216 to the club head body 212. The dual triangular hosel is formed of a first triangular member 220 positioned in a plane parallel to the ball striking face (not shown) and a second triangular member 222 positioned in a plane perpendicular to the ball striking face. The triangular members 220 and 222 include a common vertical side 230.

Figure 11:
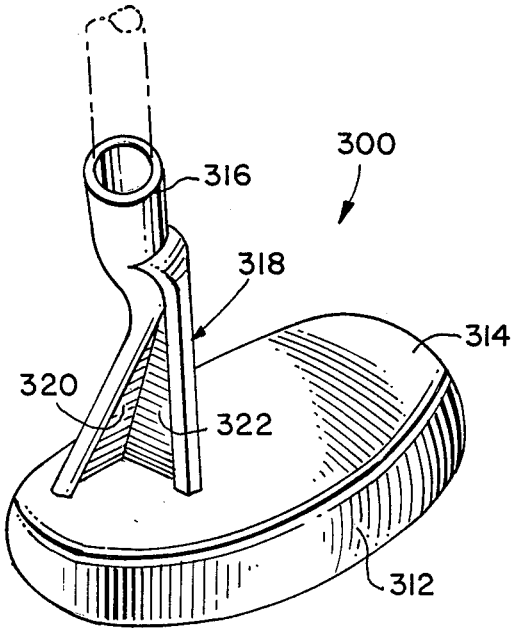
FIG. 11 is a perspective view of a fifth embodiment of the present invention.

FIG. 11 shows a fifth embodiment of a mallet type putter head golf club 300 including a club head body 312 having an upper surface 314, a shaft engaging socket 316 and a dual triangular hosel 318 positioned on the upper surface 314 and connecting the shaft engaging socket 316 and a dual triangular hosel 318 positioned on the upper surface 314 and connecting the shaft engaging socket 316 to the club head body 312. The dual triangular hosel 318 is formed of a first triangular member 320 positioned to set back from the ball striking face and in a plane parallel to the ball striking face (not shown) and a second triangular member 322 also positioned to set back from the ball striking face and in a plane perpendicular to the ball striking face. The triangular members 320 and 322 include a common vertical side (not shown) similar to the common vertical sides in the previous embodiments.

It will be appreciated that modifications may be made in keeping within the scope of the present invention as defined in the following claims.

I claim:

1. A putter type golf club head comprising:

a shaft socket structured to receive a golf club shaft;

a club head body including a heel, toe, ball striking face, an upper surface and a hosel on said upper surface connecting said shaft socket to said club head body; said hosel including a first triangular shaped member on said upper surface and in a plane parallel to said ball striking face and a second triangular shaped member on said upper surface and in a plane perpendicular to said ball striking face;

said first and second triangular shaped members being integrally formed perpendicular to each other and each having a common vertical side.

2. The putter type golf club head of claim 1 wherein said common vertical side is perpendicular to said upper surface.

3. A putter type golf club head comprising;

a club head body including a heel, toe, ball striking face, a top ridge adjacent to and located above said ball striking face, a rear wall behind said ball striking face, a lower flange extending rearwardly from said rear wall and having an upper surface thereon, and a hosel structure connecting said shaft socket to said club head body and formed of a first triangular shaped member positioned on said top ridge above said ball striking face, and in a plane parallel to said ball striking face, and a second triangular member located on said upper surface of said rearwardly extending lower flange, and positioned perpendicular to said ball striking face;

said first and said second triangular shaped members being integrally formed perpendicular to each other and each having a common vertical side.

4. The putter type golf club head of claim 3 wherein said common vertical side is perpendicular to said top ridge and extends vertically therefrom.

5. The putter type golf club head of claim 3 further characterized by a complementary weight located adjacent said toe on the club head opposite said dual hosel structure.

6. The putter type golf club head of claim 5 wherein said weight is an upstanding boss, integrally formed on said lower flange and rearwardly of said rear wall.

7. The putter type golf club head of claim 6 wherein said upstanding boss lies in a plane perpendicular to said ball striking face, and parallel to said second triangular member.

8. A putter type golf club head comprising;

a shaft socket structured to receive a golf club shaft; a club head body including a heel, toe, ball striking face, a top ridge adjacent to and located above said ball striking face, a rear wall behind said ball striking face, a rearwardly extending lower flange having an upper surface thereon, a hosel structure having a first triangular member positioned on said top ridge above said ball striking face and in a plane parallel to said ball striking face, and a second triangular member located on said upper surface of said rearwardly extending lower flange and positioned perpendicular to said ball striking face;

said first and second triangular members being integrally formed perpendicular to each other and each having a common vertical side;

and a complementary weight located adjacent said toe on the club head opposite said hosel structure.

9. The golf club head of claim 8 wherein said complementary weight is characterized as an upstanding boss, integrally formed on said lower flange and rearwardly of said rear wall.

10. A putter type golf club head comprising;

a shaft socket structure to receive a golf club shaft; a club head body including a toe and integrally formed toe mass, a heel and integrally formed heel mass, a ball striking face, a top ridge adjacent to and located above said ball striking face, a rear cavity formed behind said ball striking face between said heel and said toe masses and a hosel structure connecting said shaft socket to said club head body, said hosel structure formed by a first triangular member positioned on said top ridge above said ball striking face and in a plane parallel to said ball striking face, and a second triangular member located on said heel mass and positioned perpendicular to said ball striking face;

said first and second triangular members being integrally formed perpendicular to each other and each having a common vertical side.

11. The putter type golf club head of claim 10 wherein said common vertical side is perpendicular to said top ridge.

12. The putter type golf club head of claim 1 wherein said first triangular shaped member and said second triangular shaped member are formed to set back from said ball striking face.

* * * * *